US010813480B2

(12) United States Patent
Mittal et al.

(10) Patent No.: US 10,813,480 B2
(45) Date of Patent: Oct. 27, 2020

(54) PILLOW WITH A REMOVABLE INSERT AND METHOD OF MANUFACTURE THEREOF

(71) Applicant: Sysco Guest Supply, LLC, Somerset, NJ (US)

(72) Inventors: Khushboo Mittal, Somerset, NJ (US); Mohan Meiyappan Kandhasamy, Somerset, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 0 days.

(21) Appl. No.: 15/234,343

(22) Filed: Aug. 11, 2016

(65) Prior Publication Data

US 2017/0042350 A1 Feb. 16, 2017

Related U.S. Application Data

(60) Provisional application No. 62/204,253, filed on Aug. 12, 2015.

(51) Int. Cl.

| | |
|---|---|
| ***A47G 9/10*** | (2006.01) |
| ***A47G 9/02*** | (2006.01) |
| ***A47C 7/38*** | (2006.01) |

(52) U.S. Cl.

CPC ..... *A47G 9/10* (2013.01); *A47C 7/383* (2013.01); *A47G 9/0253* (2013.01)

(58) Field of Classification Search

CPC ..... A47G 9/10; A47G 9/0253; A47G 9/0238; A47C 7/383; A47C 7/38

(Continued)

(56) References Cited

U.S. PATENT DOCUMENTS 1,703,629 A * 2/1929 Lange ..... A47G 9/10 428/6
2,344,093 A * 3/1944 Kotowicz ..... A47C 31/11 297/228.1

(Continued)

FOREIGN PATENT DOCUMENTS

CN 2609444 4/2004
CN 2671447 Y 1/2005

(Continued)

*Primary Examiner* — Robert G Santos
(74) *Attorney, Agent, or Firm* — Bracewell LLP; Brad Y. Chin; Vivek P. Shankam

(57) ABSTRACT

A pillow is provided with an insert or inner pillow that is removable. Having removable insert or inner pillow enables filling of the removable inner pillow with a different filling material that is not amenable to washing. Thus the outer pillow that is in contact with a person's body and tends to accumulate dust and microbes among the fill can be washed after removal of the insert or inner pillow. The insert or inner pillow can be filled with a less expensive filling material such as synthetic fibers, viscoelastic foam, latex etc. whereas the outer pillow can have a superior quality filling material that is softer, fluffier and has better insulating properties such as down or down mixed/blended with feather, thus providing an affordable pillow with comfort and superior characteristics of down and can be laundered to maintain hygiene. The outer surface of the inner pillow may include a fluid impermeable material.

25 Claims, 5 Drawing Sheets

(58) Field of Classification Search
USPC ..... 5/645, 636, 639, 640, 490
See application file for complete search history.

(56) References Cited

U.S. PATENT DOCUMENTS

| | | | | | |
|---|---|---|---|---|---|
| 2,400,731 | A * | 5/1946 | Armstrong | A47C 27/006 | 150/154 |
| 2,944,266 | A * | 7/1960 | Wertheimer | A47G 9/10 | 5/645 |
| 3,148,389 | A * | 9/1964 | Lustig | A47C 27/144 | 5/643 |
| 3,241,161 | A * | 3/1966 | Dashosh | A47G 9/0261 | 383/66 |
| 3,443,267 | A * | 5/1969 | Schuckman | A47G 9/10 | 5/645 |
| 4,930,173 | A * | 6/1990 | Woller | A47C 27/144 | 297/452.48 |
| 4,949,411 | A | 8/1990 | Tesch | | |
| 4,959,880 | A | 10/1990 | Tesch | | |
| 5,157,799 | A * | 10/1992 | Aird | A47G 9/0253 | 5/490 |
| 5,388,293 | A * | 2/1995 | Kistner | A47G 9/0253 | 297/229 |
| 5,974,607 | A * | 11/1999 | Smith | A61G 7/072 | 297/393 |
| 6,910,237 | B2 * | 6/2005 | DiGirolamo | A47G 9/0253 | 5/490 |
| 6,928,675 | B2 * | 8/2005 | Hamilton | A47G 9/0253 | 5/490 |
| 6,988,286 | B2 * | 1/2006 | Schecter | A47G 9/10 | 5/645 |
| 7,051,389 | B2 * | 5/2006 | Wassilefky | A47G 9/10 | 5/490 |
| 7,415,742 | B2 * | 8/2008 | Wassilefsky | A47G 9/10 | 5/490 |
| 7,530,127 | B2 * | 5/2009 | Leifermann | A47G 9/1081 | 5/490 |
| 7,735,169 | B2 * | 6/2010 | Wassilefsky | A47G 9/10 | 5/490 |
| 7,788,750 | B2 * | 9/2010 | Norstrem | A47G 9/10 | 5/640 |
| 8,656,537 | B2 * | 2/2014 | Leifermann | A47G 9/0253 | 5/636 |
| 9,314,118 | B2 * | 4/2016 | Blazar | A47G 9/1027 | |
| 2004/0019972 | A1 * | 2/2004 | Schecter | A47G 9/10 | 5/645 |
| 2004/0154101 | A1 | 8/2004 | DiGirolamo | | |
| 2005/0076442 | A1 * | 4/2005 | Wassilefky | A47G 9/10 | 5/636 |
| 2005/0150048 | A1 * | 7/2005 | Hamilton | A47G 9/0253 | 5/490 |
| 2006/0277684 | A1 * | 12/2006 | Wassilefky | A47G 9/10 | 5/636 |
| 2007/0044239 | A1 | 3/2007 | Leifermann et al. | | |
| 2007/0107131 | A1 | 5/2007 | Fux | | |
| 2007/0226908 | A1 * | 10/2007 | Hollander | A47G 9/0253 | 5/636 |
| 2007/0245493 | A1 | 10/2007 | Leifermann et al. | | |
| 2007/0261170 | A1 * | 11/2007 | Hollander | A44B 19/301 | 5/636 |
| 2008/0307581 | A1 * | 12/2008 | Wassilefky | A47G 9/10 | 5/636 |
| 2009/0019641 | A1 * | 1/2009 | Ali | B60N 2/4882 | 5/636 |
| 2009/0199341 | A1 | 8/2009 | Schantz | | |
| 2009/0211030 | A1 * | 8/2009 | Norstrem | A47G 9/10 | 5/640 |
| 2010/0024131 | A1 | 2/2010 | Palmer et al. | | |
| 2012/0060280 | A1 * | 3/2012 | Kelly | A47G 9/0253 | 5/490 |
| 2013/0019409 | A1 * | 1/2013 | Blazar | A47G 9/1027 | 5/644 |
| 2013/0263377 | A1 | 10/2013 | Wootten, Jr. | | |
| 2013/0263386 | A1 * | 10/2013 | Romero | A47G 9/00 | 8/137 |
| 2014/0196214 | A1 | 7/2014 | DuPre | | |
| 2014/0223664 | A1 * | 8/2014 | Kanbar | A47G 9/10 | 5/636 |
| 2016/0073803 | A1 * | 3/2016 | Sheeler-Johnson | A47G 9/10 | 5/640 |
| 2017/0042350 | A1 * | 2/2017 | Mittal | A47G 9/10 | |
| 2019/0290033 | A1 * | 9/2019 | Lonstein | A47G 9/10 | |

FOREIGN PATENT DOCUMENTS

| | | | |
|---|---|---|---|
| CN | 2936029 | Y | 8/2007 |
| CN | 201005392 | Y | 1/2008 |
| CN | 101238940 | A | 8/2008 |
| CN | 202104633 | | 1/2012 |
| CN | 102652636 | | 9/2012 |
| CN | 203709707 | U | 7/2014 |
| CN | 104414301 | | 3/2015 |
| CN | 205180961 | U | 4/2016 |

* cited by examiner

PILLOW WITH A REMOVABLE INSERT AND METHOD OF MANUFACTURE THEREOF

CROSS REFERENCE TO RELATED APPLICATIONS

This application claims priority of U.S. Provisional patent application 62/204,253 titled "Pillow with a removable insert" filed on Aug. 12, 2015, the entire contents of which is incorporated herein by reference.

TECHNICAL FIELD

Example embodiments relate to an improved down pillow having an interior pocket for receiving a removable insert to provide rigidity and shape to the down pillow with the removable insert being surrounded by down material.

BACKGROUND

A comfortable sleep is greatly influenced by a pillow used by a person. The pillow provides support to the head and neck or other parts of the body when the user lies in a supine, prone, or side-lying position. The amount of support desired depends upon the users sleeping position. In contemporary western culture pillows consist of a fabric envelope which contains a soft stuffing. They may also be used for supporting body as used on a couch or chair and for such applications, term 'cushion' is used in some countries. Pillows are typically covered with a cloth pillowcase/pillow cover.

Various factors relating to the pillow that affect a comfortable sleep are pillow height, hardness, material and size. Factors such as fragrance, color and sound also play a role and generally users prefer a pillow that fit his preferences in respect of these parameters. Further, other conditions relating to the head's ventilation, absorption of humidity and moisture vaporization, heat insulation and ability to naturally turn in bed are also important elements of a most comfortable pillow.

To meet individual preferences and for one or more reasons enumerated above, pillows are made in different sizes, with different filling materials, different covering materials and in different constructional configurations. The bed pillow shape is usually a square or rectangle. In the US, they are commonly available in three sizes: Standard (20×26 inches), Queen (20×30 inches), and King (20×36 inches). A less common size is Jumbo (20×28 inches) which is in between the Standard Size and the Queen Size.

The stuffing material for contemporary pillows is often made from viscoelastic foam, latex, synthetic plastic fibers and feathers or down. Feathers and down are the most expensive and usually the most comfortable. They offer the advantages of softness and ability to conform to shapes desired by the user, more so than foam or fiber pillows. One of the disadvantages of a down-filled pillow is that a significant number of people are allergic to them. Fiber filled pillows are preferred by users who may be allergic to feathers or down. Fiber filled pillows are typically filled with synthetic fibers, such as puffball polyester fiberfill, also known simply as puffballs or polyester fiberfill. The puffballs are puff-blown polyester fiberfill that is resilient, fluffable and shapeable. However, the polyester puffball or fiberfill tends to become compressed after use and requires a user to fluff the pillow. Even with fluffing, the polyester puffball or fiberfill tends to remain compressed after several uses.

For the above reasons feathers and down are the preferred stuffing materials for pillows especially for high end users. There are currently hypoallergenic varieties of down pillows to allow people sensitive to down to enjoy the comfort of feather or down pillows. The down of birds (goose or duck) is a layer of fine feathers found under the tougher exterior feathers. Down is a fine thermal insulator and padding and extensively used in goods such as jackets, duvets and sleeping bags besides pillows. Very young birds are clad only in down. Down compacts with age and is not appropriate for some applications; most down-filled pillow forms are stuffed with a combination of down and feathers. The presence of feathers adds weight, stability and bulk. Therefore, a mixture with more down will be lighter and fluffier than a pillow with a higher feather ratio. In the United States, regulations require that any product labeled "100% Down" must contain only down clusters, while products labeled simply "Down" can contain a mixture of down and feathers. In addition, products labeled as "Goose Down" must contain at least 90% goose down. It is usual to mix pure down and feather in ratios such as 50/50, 30/70, 20/80 or 10/90 to make them affordable in view of cost difference between down and feather.

One factor as a condition of comfortable sleep that is often overlooked while considering suitability of a pillow is cleanliness and hygiene involved with pillow. It is not uncommon for a pillow to be used by different people on different days and is unavoidable in hospitality industry. Even in domestic applications, pillows may be used by guests and may need laundering. For this reason the pillows are generally covered with a removable pillowcase which becomes the part that is in contact with a person's body, and facilitates laundering. But even with regular change and washing of pillowcase, pillows tend to accumulate dust and microbes among the fill.

There is therefore a need to launder the pillows, irrespective of their stuffing material, at intervals to maintain hygiene and cleanliness. Down and feathers tend to become more allergenic as they age, as they become contaminated with molds and dust mites. Pillows provide the most common source of exposure, though mattresses, comforters, outer wears and upholstery can also cause problems. A study has shown that true feather allergies are rare, with most issues caused by dust mites.

While pure down can be washed and generally remains unaffected, quill of the feather are susceptible to breaking and therefore frequent washing of pillows made of a combination of down and feather shall result in reduced life of the pillow. There is therefore a need in the art to provide a solution that can overcome above limitation of using combination of down and feather in pillows.

SUMMARY

Embodiments of present disclosure relate to a pillow. In accordance with one embodiment, the disclosed pillow is characterized by at least one part of the pillow being configured to be removable. Having at least one part of the pillow being removable enables filling of the removable part with a different filling material that is not amenable to washing.

In accordance with one embodiment, a removable part of the pillow can be an insert or inner part and the other part can be an outer part wherein the insert or inner part can be configured to fit within the outer part and can be inserted or removed by sliding in or out through an opening on the side of the outer part. Suitable means can be provided to close the opening after the removable insert or inner part of the pillow has been inserted in. The suitable means can be a zipper or Velcro or other like means, fixed on opposite sides of the opening.

In accordance with one embodiment, the removable insert or inner part of the pillow can be in shape of a pillow that enables its use as an additional pillow, if required. Further removal of the removable insert or inner part of the pillow reduces height of the pillow and it retains other characteristics for use as a pillow of lesser height. Thus the insert or inner part can be an inner pillow and the outer part can be an outer pillow.

In accordance with one embodiment, inner surface of the outer part (or outer pillow and the two terms used interchangeably hereinafter) and outer surface of the insert or inner part (or inner pillow and the two terms used interchangeably hereinafter) can be configured such that inner pillow smoothly slides into void of the outer pillow.

In accordance with one embodiment, the removable inner pillow can be filled with a filling material that provides weight, stability and bulk to the pillow but is not amenable to washing to maintain hygiene whereas the outer pillow can have a filling material that is not affected by washing. Thus filling of the removable inner pillow with a different filling material than the outer pillow provides a pillow that can be washed to maintain hygiene after removing the removable inner pillow that is not exposed to dust and microbes to the same extent as the outer pillow.

In accordance with one embodiment, the removable inner pillow can be filled with a less expensive filling material whereas the outer pillow can have a superior quality filling material that is softer, fluffier and has better insulating properties. Thus filling of the inner pillow with a different filling material than the outer pillow provides an affordable pillow without sacrificing fluffiness, softness and insulating properties of a superior and expensive filling material.

In accordance with one embodiment, the outer pillow can be filled with down or down mixed/blended with feather. Having the outer pillow filled with down or down mixed/blended with feather provides a pillow with superior properties in respect of softness, fluffiness, and insulating properties.

In accordance with one embodiment, the removable inner pillow can be filled with feather or feather mixed/blended with down or any other material such as synthetic fibers viscoelastic foam, latex etc. Having the removable inner pillow filled with feather or feather mixed/blended with down or any other material such as synthetic fibers, viscoelastic foam, latex etc. while the outer pillow is filled with down, provides an affordable pillow with comfort and superior characteristics of down and can be laundered to maintain hygiene.

Accordingly, one example embodiment is a pillow including an outer pillow having an inner cavity. The inner cavity is accessible through an opening on at least one side of the outer pillow and the opening can be configured with means to close the opening. The pillow may also include an insert or inner pillow configured to removably fit into the inner cavity of the outer pillow when inserted through the opening. The outer pillow may include a first stuffing material, and the first stuffing material may include natural or synthetic fillers. According to one embodiment, the first stuffing material for the outer pillow may include down or down mixed or blended with feather. The first stuffing material for the outer pillow may include polyester or foam or any other synthetic material. The insert or inner pillow may include a second stuffing material, the second stuffing material comprising natural or synthetic fillers. According to one embodiment, the second stuffing material for the insert or inner pillow comprises blown fibers, cluster fibers, garneted fibers, shredded foam, down, feather, or combinations thereof. According to one embodiment, the second stuffing material for the insert or inner pillow comprises polyester or foam or any other synthetic material.

The means to close the opening may include a zipper or Velcro or a snap button. According to one embodiment, the zipper may not conspicuous or easily seen or readily visible on the outside of the pillow. The surfaces of the inner cavity and outer surface of the insert or inner pillow may be lined with a smooth fabric that facilitates smooth insertion and removal of the insert or inner pillow from the inner cavity in the outer pillow. The outer and inner surfaces of the outer pillow and the outer surface of the insert or inner pillow may include down proof material as defined by the International Down and Feather Testing Laboratory (IDFL). According to one embodiment, the outer surface of the inner pillow may include a fluid impermeable material.

Another example embodiment is a pillow including an outer pillow having an inner cavity, the inner cavity being accessible through an opening on at least one side of the outer pillow, and an insert or inner pillow configured to removably fit into the inner cavity of the outer pillow when inserted through the opening. The opening may be configured with a zipper, Velcro, or a snap button to close the opening. The outer pillow may include a first stuffing material, the first stuffing material comprising natural or synthetic fillers. The first stuffing material for the outer pillow may include down or down mixed or blended with feather. The insert or inner pillow may include a second stuffing material, the second stuffing material comprising natural or synthetic fillers. The second stuffing material for the insert or inner pillow may include blown fibers, cluster fibers, garneted fibers, shredded foam, down, feather, or combinations thereof.

Another example embodiment is a method for manufacturing a pillow. The method may include providing an outer pillow having an inner cavity, the inner cavity being accessible through an opening on at least one side of the outer pillow, and providing an insert or inner pillow configured to removably fit into the inner cavity of the outer pillow when inserted through the opening. The method may also include configuring the opening with a closing means to close the opening, the closing means comprising at least one of a zipper, a Velcro, and a snap button.

Various objects, features, embodiments and advantages of the inventive subject matter will become more apparent from the following detailed description of preferred embodiments, along with the accompanying drawing figures in which like numerals represent like components

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

Figure 1:
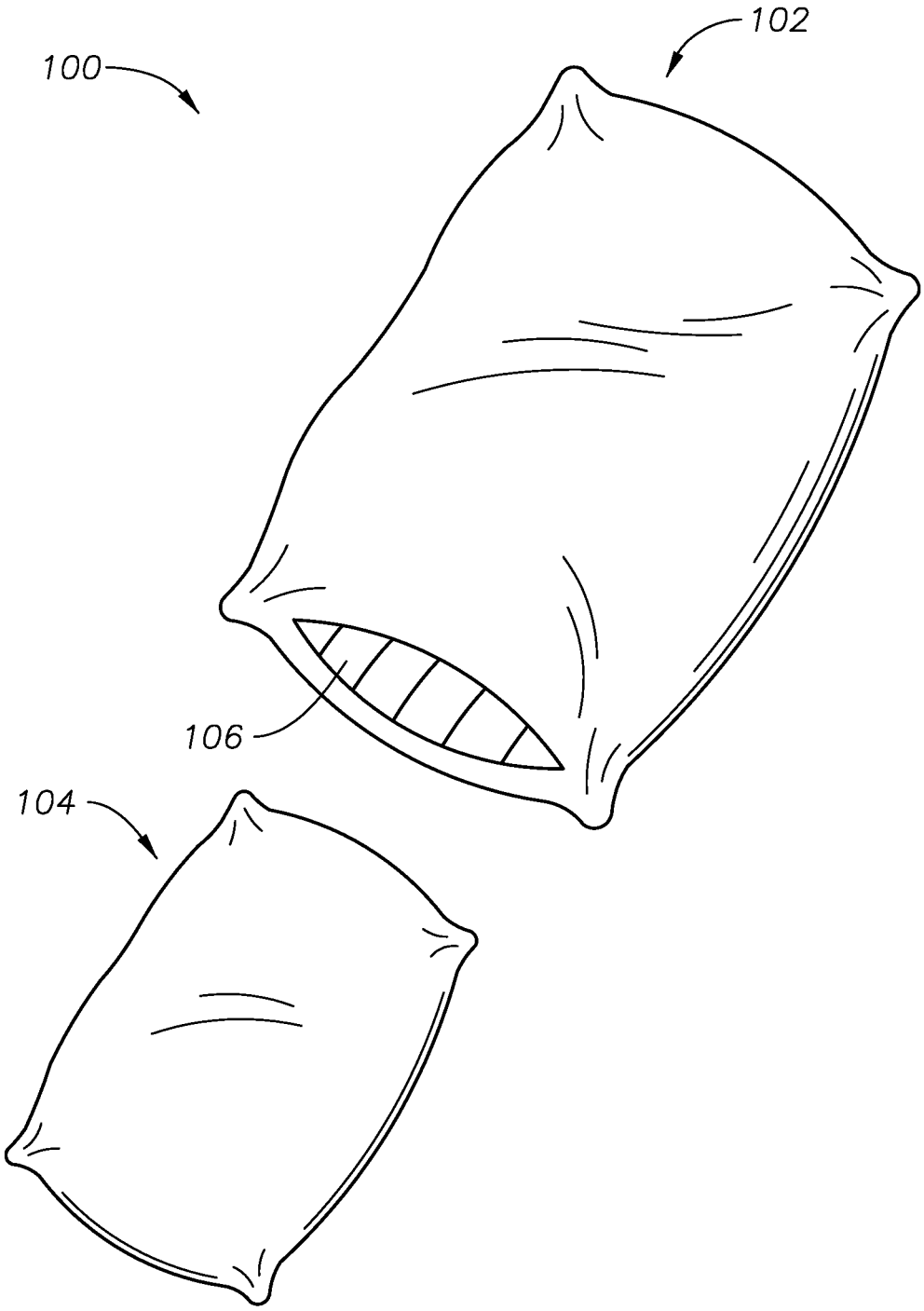
FIG. 1 illustrates a schematic representation of a pillow having an outer pillow and inner pillow or insert in accordance with one embodiment of the present disclosure.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The present disclosure and the example embodiments disclosed herein addresses the above and other possible needs relating to the field of pillows.

All publications herein, if incorporated, are by reference to the same extent as if each individual publication or patent applications were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Various terms as used herein are shown below. To the extent a term used in the instant application is not defined below, it should be given the broadest definition persons in the pertinent art have given that term as reflected in printed publications and issued patents at the time of filing.

The expression "pillow" referred to in the present application refers to a fabric case filled with fillers including but not limited to one or more combinations of viscoelastic foam, latex, synthetic fibers, feathers, down and the like. All embodiments claimed and described herein with regards to "pillow" are understood to include "pillow" used to provide support to head and neck or other parts of the body when the user lies in a supine, prone, or side-lying position or for use as 'cushion' to support body on a sofa, couch, love seat, chair and the like.

The expression "pillow case" referred to in the present application refers to sheets configured to fit snugly over pillows. The expression "down" referred to in the instant application refers to filling material obtained from layer of fine feathers found under the tougher exterior feathers of birds. Any reference to "down" means pure or 100% down without any blending with other feathers.

The expression "feather" referred to in the instant application refers to feathers other than "down" that are used as filling material for thermal insulation and padding.

In some embodiments, the numbers expressing quantities of ingredients, properties such as concentration, reaction conditions, and so forth, used to describe and claim certain embodiments of the disclosure are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the disclosure are approximations, the numerical values set forth in the specific examples are reported as precisely as practicable. The numerical values presented in some embodiments of the disclosure may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values, if used herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the disclosure and does not pose a limitation on the scope of the disclosure otherwise claimed. No language in the specification should be construed as indicating any non-claimed element essential to the practice of the claimed inventions.

Groupings of alternative elements or embodiments of the disclosure, if any, disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the embodiments and does not pose a limitation on the scope of the disclosure otherwise claimed. No language in the specification should be construed as indicating any non-claimed element essential to the practice of the claimed inventions.

Embodiments of the present disclosure relate to a pillow. Pillows provide support to the head and neck or other parts of the body when its user lies in a supine, prone, or side-lying position or other body parts as used on a couch or chair. Even with regular change and washing of pillowcase, pillows tend to accumulate dust and microbes among the fill and therefore need to be washed at regular interval. A preferred material by higher end segment of public and thus so by upscale and luxury hotels, for stuffing the pillows is down which is very expensive. It is therefore a normal practice to mix or blend feathers with down to bring down cost. However, quill of the feather are susceptible to breaking and therefore frequent washing of pillows made of combination of down and feather shall result in reduced life of the pillow. Pillows should provide comfort of down and should at the same time be affordable and washable. The present disclosure aims to provide a pillow that can address these requirements.

FIG. 1 illustrates a schematic representation of an exemplary pillow 100 having outer pillow 102 and inner pillow 104. The outer pillow 102 can be configured with an internal cavity 106 to hold the inner pillow 104. To facilitate insertion and removal of the inner pillow to or from the cavity 106, at least one side of the outer pillow 102 can be open to provide access to the cavity 106.

Figure 2:
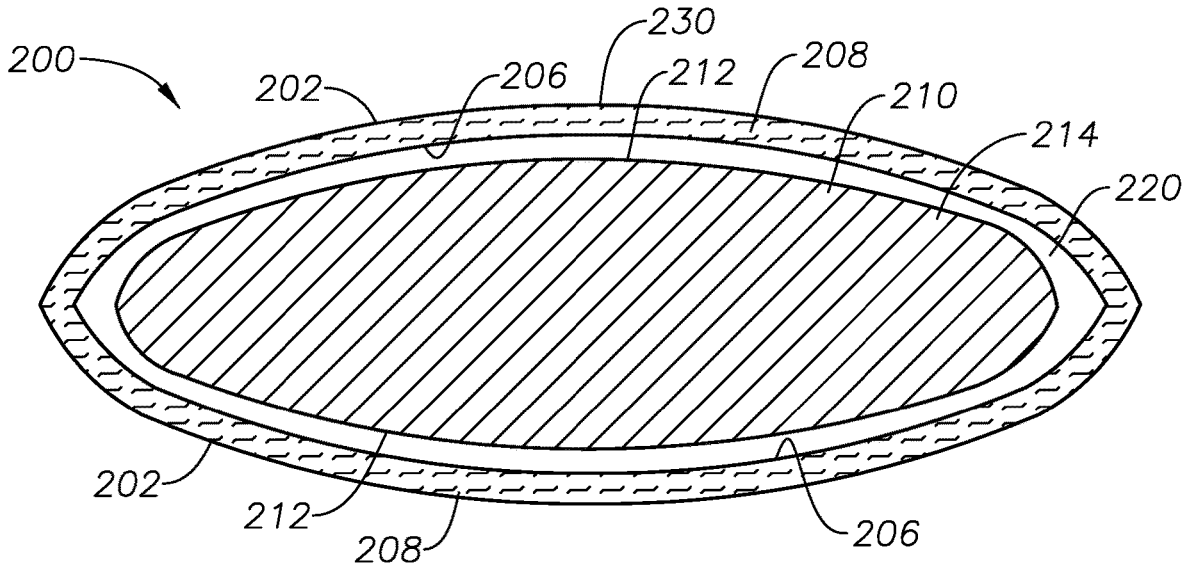
FIG. 2 illustrates a cross sectional view of a pillow showing an inner pillow or insert placed within the inner cavity of an outer pillow in accordance with one embodiment of the present disclosure.

FIG. 2 illustrates a cross sectional view of a pillow 200 showing an inner pillow 210 placed within the inner cavity 220 of the outer pillow 230. The cavity 220 and the inner pillow 210 can be sized such that that the inner pillow 210 can be moved in and out of the cavity 220 easily and fill the cavity 220, and at the same time fits therein such that there is no scope of sideways shifting of inner pillow 210 within the cavity 220 while the pillow 200 is in use.

The present disclosure provides various embodiments to meet the intended objects of the disclosure. In one embodiment, the two pillows i.e. the inner pillow 210 and the outer pillow 230 can be filled with different filling materials. In one embodiment, the two materials filled in the inner pillow 210 and the outer pillow 230 can be selected based on one or more embodiments of the pillow 200 such as cost, softness, shape, weight, hygiene and other like embodiments.

In one embodiment, the removable inner pillow 210 can be filled with a filling material 214 that provides weight, stability and bulk to the pillow 200 in combination with a soft and fluffy material 208 with superior thermal properties in the outer pillow 230. In one embodiment, such a combination can provide a pillow that retains its shape, has stability and has desirable weight and yet provides softness and fluffiness to the user.

In one embodiment, the removable inner pillow 210 can be filled with an affordable cheaper filling material in combination with a superior expensive material that is soft, fluffy and has superior thermal properties in the outer pillow 230. In one embodiment, such a combination can provide an affordable pillow without sacrificing comfort, softness, fluffiness and superior thermal properties.

In one embodiment, the inner pillow 210 can be filled with an affordable cheaper filling material which is not amenable to laundering in combination with a superior expensive material in the outer pillow 230 that can be washed without adverse effect on life of the filling material. In one embodiment, such a combination can provide an affordable pillow that can be washed to maintain hygiene after removing the removable inner pillow 210 that is not exposed to dust and microbes to the same extent as the outer part.

In one embodiment, the outer pillow 230 can be filled with down or down mixed/blended with feather. Having the outer pillow filled with down or down mixed/blended with feather provides a pillow with superior properties in respect of softness, fluffiness, and insulating properties.

The outer pillow 230 may include a stuffing material 208 comprising natural or synthetic fillers. According to one embodiment, the stuffing material 208 for the outer pillow 230 may include down or down mixed or blended with feather. The stuffing material 208 for the outer pillow 230 may include polyester or foam or any other synthetic material. The outer and inner surfaces 202, 206 of the outer pillow 230 and the outer surface 212 of the insert or inner pillow 210 may include down proof material as defined by the International Down and Feather Testing Laboratory (IDFL).

In one embodiment, the removable inner pillow 210 can be filled with feather or feather mixed/blended with down or any other material such as synthetic fibers viscoelastic foam, latex etc. Having the removable inner pillow filled with feather or feather mixed/blended with down or any other material such as synthetic fibers, viscoelastic foam, latex etc. while the outer pillow is filled with down, provides an affordable pillow with comfort and superior characteristics of down and can be laundered to maintain hygiene.

The insert or inner pillow 210 may include a stuffing material 214 comprising natural or synthetic fillers. According to one embodiment, the stuffing material 214 for the insert or inner pillow 210 includes blown fibers, cluster fibers, garneted fibers, shredded foam, down, feather, or combinations thereof. According to one embodiment, the stuffing material 214 for the insert or inner pillow 210 comprises polyester or foam or any other synthetic material.

In one embodiment, the inner pillow 210 can be in shape of a pillow that enables its use as an additional pillow, if required. Further, removal of the inner pillow 210 reduces height of the pillow but it retains other characteristics for use as a pillow of lesser height.

In one example, the outer pillow 230 may include a stuffing material comprising about 70-99% down cluster and about 1-30% feather by volume. The inner pillow 210 may include a stuffing material comprising down, feather, blown fibers, cluster fibers, garneted fibers, shredded foam, or combinations thereof. In one example embodiment, the outer pillow 230 may constitute about 5-15% of the pillow 100, 200, 300 by volume and the inner pillow 210 may constitute about 85-95% of the pillow 100, 200, 300 by volume. The stuffing material 208 for the insert or inner pillow 210 may comprise blown fibers, cluster fibers, garneted fibers, shredded foam, down, feather, or combinations thereof. Polyester fibers of different forms may be used for this purpose. In one example, the inner pillow or insert 210 may include blowable polyester fibers. In another example, the inner pillow or insert 210 may include garneted polyester comprising about 0.25-0.50 inch polyester balls. In another example, the inner pillow or insert 210 may include a web of polyester fibers folded into two or more layers. Gel fibers may be used for the blown fibers discussed above, which are typically polyester fibers slickened by using silicone or a gel coating which is further used to fill pillows and comforters.

In one embodiment, inner surface 206 of the outer pillow 230 (surfaces of the cavity 220) and outer surface 212 of the inner pillow 210 can be configured such that inner pillow 210 smoothly slides into cavity 220 of the outer pillow 230. In one embodiment, inner surface 206 of the outer pillow 230, i.e. surfaces of the cavity 220 and outer surface 212 of the inner pillow 210 can be lined with a smooth fabric made of a smooth material such as but not limited to silk. In another example embodiment, outer surface 202 of the outer pillow 230 may also be made of a smooth material, such as silk.

In one example embodiment, the outer surface 212 of the inner pillow 210 may be made of a fluid impermeable material such that the outer surface 212 is impervious to any bodily fluids, such as saliva. The impermeability of the outer surface 212 may be a result of the material used to form the outer surface 212, or the outer surface 212 may be treated with a surface coating to provide the fluid impermeability.

Figure 3:
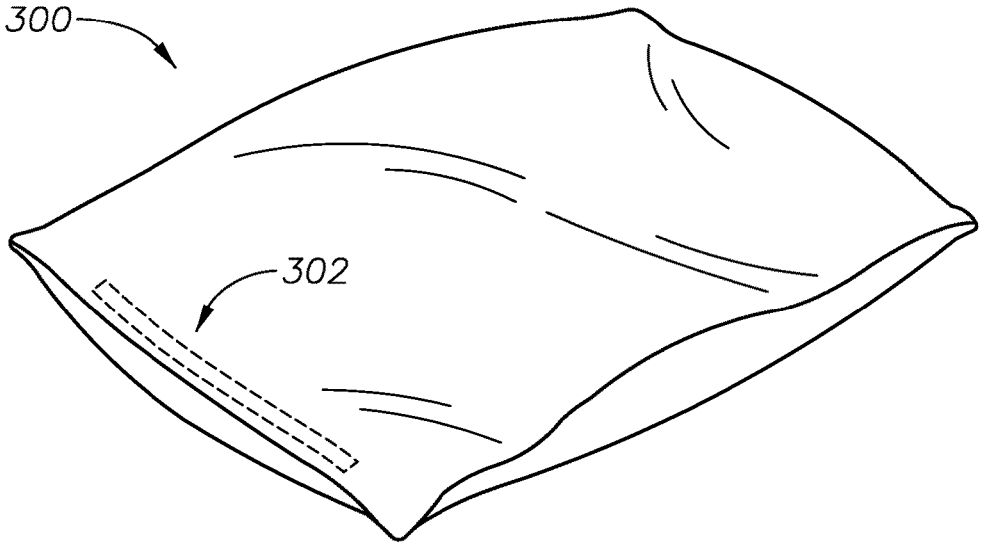
FIG. 3 illustrates a schematic representation of a closing means configured on one side of an outer pillow of a pillow in accordance with one embodiment of the present disclosure.

Turning now to FIG. 3, the opening on one or more sides of the outer pillow that provides access to the internal cavity of the outer pillow 230 can be configured with suitable means 302 to close the opening after the inner pillow 210 has been inserted. Alternatively the opening can be closed after removal of the inner pillow 210.

In one embodiment, the suitable means to close the opening 302 on the side of the outer pillow 230 can be a zipper or Velcro or other like means wherein the two mating parts of the zipper or Velcro can be fixed on opposite sides of the opening. In one embodiment, the opposite sides can be configured such that the closing means are not conspicuous by being readily visible and spoil the presentation of the pillow 300 after the open side has been closed after insertion or removal of the inner pillow 210. FIG. 3 illustrates an exemplary schematic representation of closing means configured on the side of the outer pillow 230. Closing means 302 can be configured on opposite sides of the opening of the outer pillow and as shown shall not be readily visible.

Figure 4A:
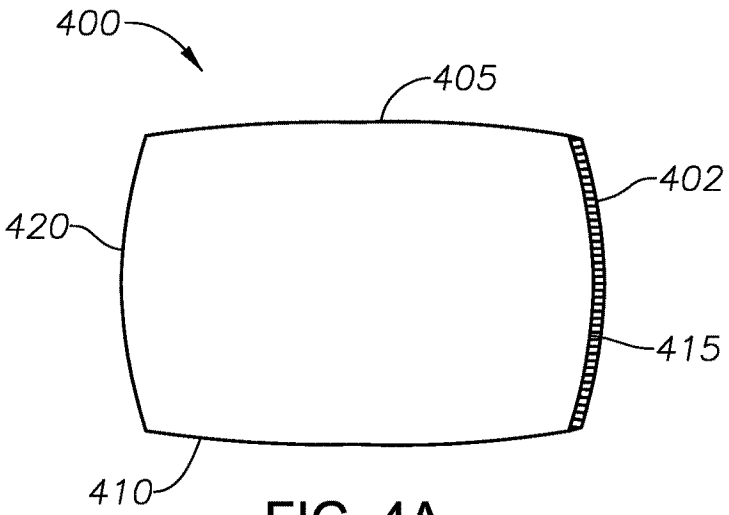
FIGS. 4A-4D illustrate schematics of a closing means configured on one or more sides of an outer pillow in a pillow in accordance with one or more embodiments of the present disclosure.
Figure 4B:
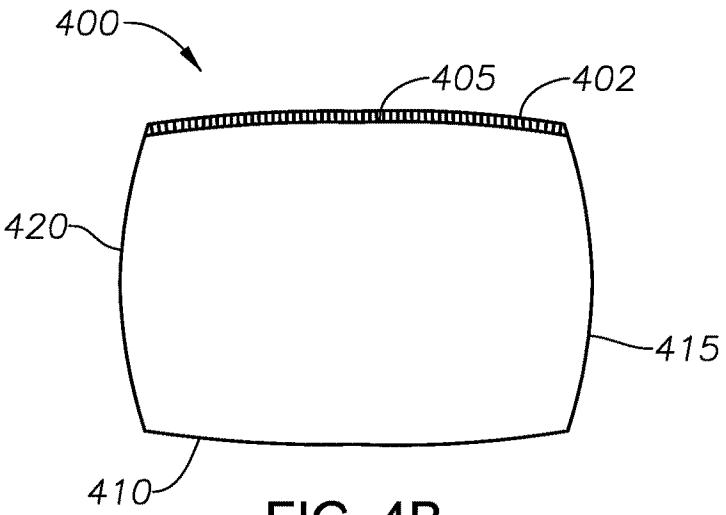
Figure 4C:
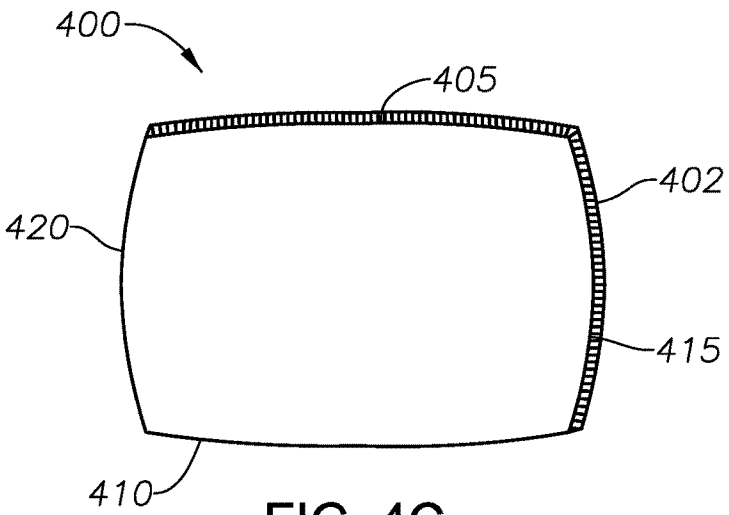
Figure 4D:
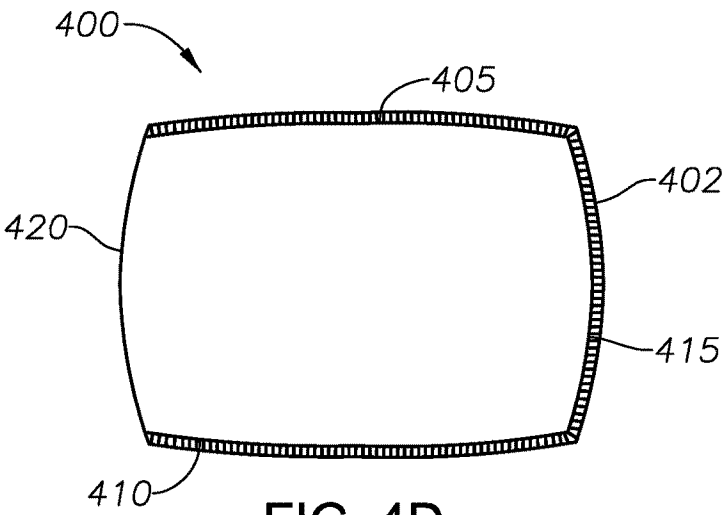

FIGS. 4A-4D illustrate top views of different variations of the pillow 400, according to one or more example embodiments of the disclosure. Pillow 400 may have a top edge 405, a bottom edge 410, a right side edge 415, and a left side edge 420, and the pillow 400 may include a closing means, such as a zipper 402, on or more these edges. As illustrated in FIG. 4A, pillow 400 may include a zipper 402 on its right side edge 415. As illustrated in FIG. 4B, pillow 400 may include a zipper 402 on its top edge 405. As illustrated in FIG. 4C, pillow 400 may include a zipper 402 that runs along its top edge 405 and right side edge 415. As illustrated in FIG. 4D, pillow 400 may include a zipper 402 that runs along its top edge 405, right side edge 415, and the bottom edge 410. Providing zipper 402 on edges more than one edge enables easy insertion and removal of the inner pillow into and from the outer pillow illustrated in FIGS. 1-3.

Figure 5A:
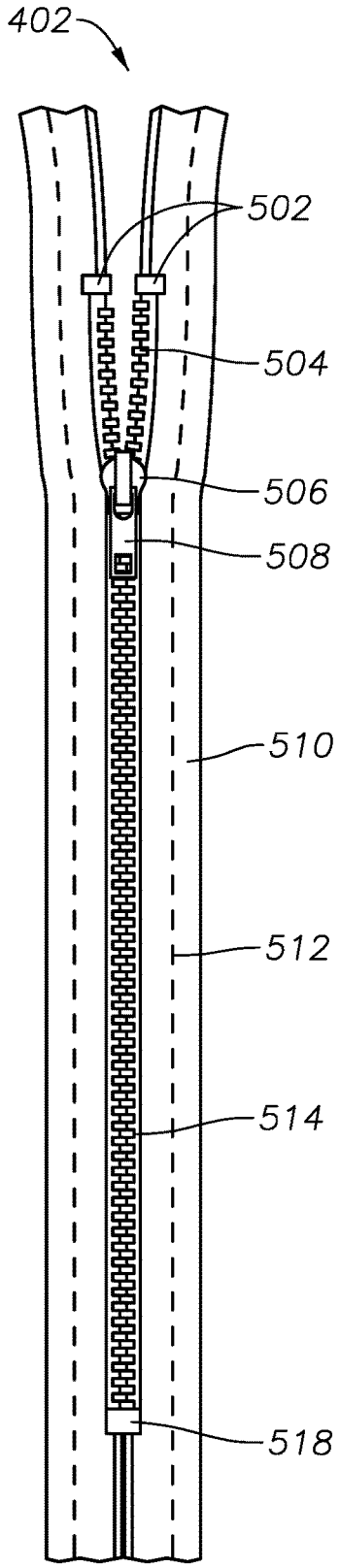
FIGS. 5A-5C illustrate schematics of different types of zippers used in a pillow in accordance with one or more embodiments of the present disclosure.
Figure 5B:
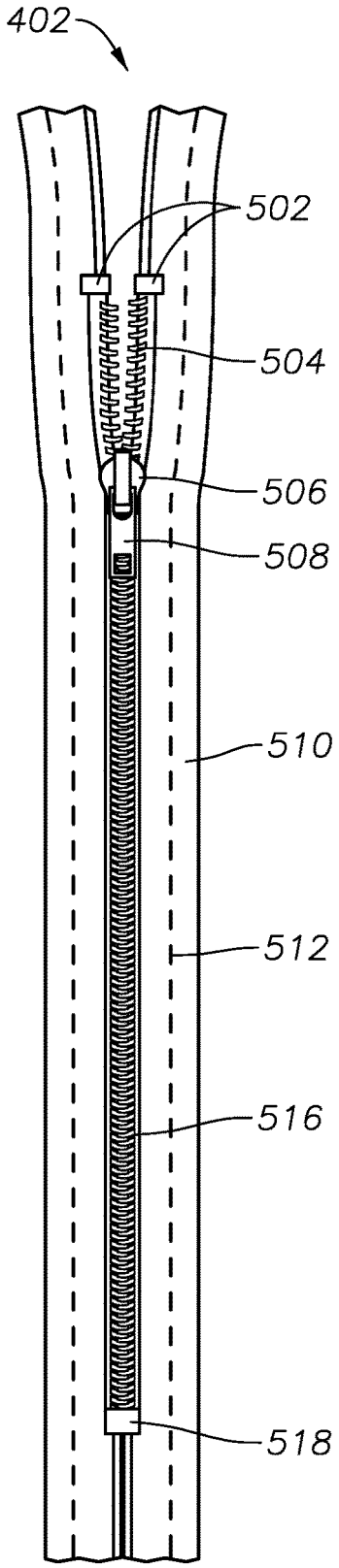
Figure 5C:
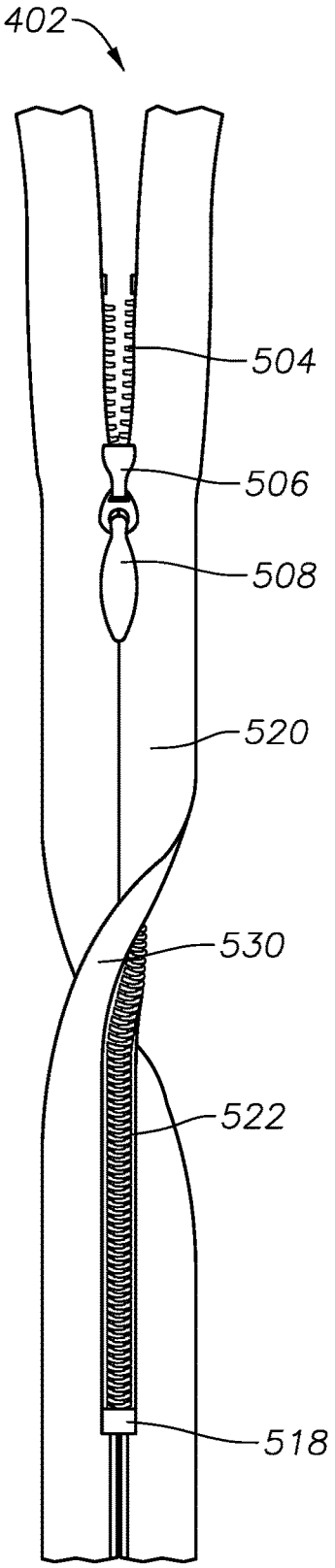

FIGS. 5A-5C illustrate different variations of the zipper 402, according to one or more example embodiments of the disclosure. Zipper 402 may include a chain or coil 514, 516, 522 a slider 506 with a tab 508 for pulling the slider 506 up and down the chain or coil 514, 516, 522, a top stop 502 and a bottom stop 518. The chain or coil 514, 516, 522 may be made of metal or plastic, and may form at least a portion of teeth 504 that support the movement of slider 506 up and down the zipper 402. Zipper 402 may also include one or more tapes 510, 520, the edges along which the chain or coil 514, 516, 522 may be installed. Zipper 402 may also include a visible or invisible stitching guideline 512 that may be used to sew to the fabric of the pillow to the zipper 402. As illustrated in FIG. 5A, zipper 402 may include a metal or plastic chain 514 with a stitching guideline 512. As illustrated in FIG. 5B, zipper 402 may include a coil 516 with a stitching guideline 512. As illustrated in FIG. 5C, the zipper may include an invisible zipper such the zipper is not conspicuous or easily seen or readily visible on the outside of the pillow. The coil 522 may be installed in such a manner that the coil 522 is concealed on the front 520 of the tape 510, and visible on the back 530 of the tape 510. This feature may partially or completely conceal the chain or coil 522 such that the zipper 402 provides added comfort to the user, and improved aesthetic to the pillow itself.

In addition to the embodiments and examples shown, numerous variants are possible, which may be obvious to a person skilled in the art relating to the embodiments of the disclosure.

Figure 6:
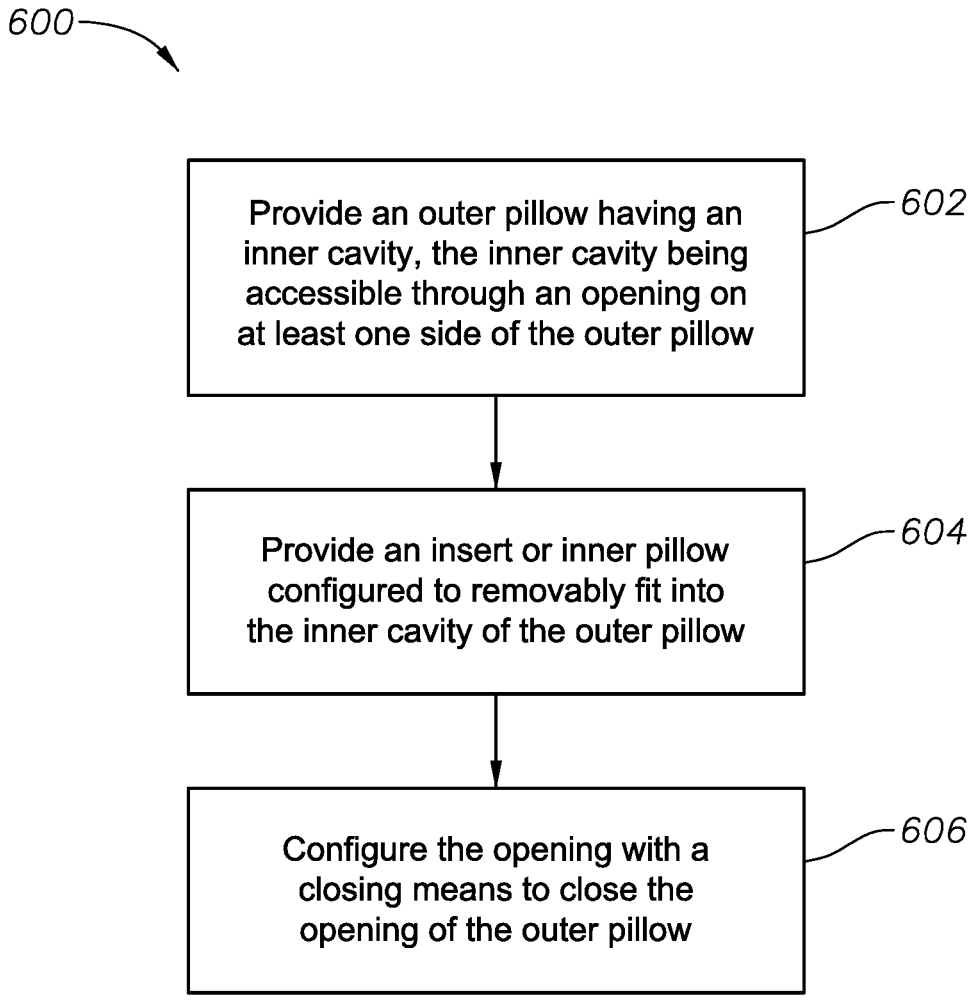
FIG. 6 illustrates example operations in a method for manufacture of a pillow in accordance with one or more embodiments of the present disclosure.

Another example embodiment is a method 600 for manufacturing a pillow, as illustrated in FIG. 6, for example. The method 600 may include an operation 602 of providing an outer pillow having an inner cavity, the inner cavity being accessible through an opening on at least one side of the outer pillow. The method may also include an operation 604 of providing an insert or inner pillow configured to removably fit into the inner cavity of the outer pillow when inserted through the opening. The method may also include an operation 606 of configuring the opening with a closing means to close the opening, the closing means comprising at least one of a zipper, a Velcro, and a snap button.

Therefore, the present disclosure provides pillows that can be washed to maintain hygiene. The present disclosure provides pillows that are easy to wash. The present disclosure provides pillows that make use of combination of down and feather to make them affordable and yet have advantages of 100% down. The present disclosure provides pillows that, if required, can be converted to two pillows. The present disclosure provides pillows whose height can be reduced if required. The present disclosure provides pillows whose life does not reduce due to washing to maintain hygiene. The present disclosure provides cost effective pillows. The present disclosure provides pillows that combine weight, stability and bulk of feather and fluffiness, softness and insulating properties of 100% down.

Example embodiments disclosed may result in significant energy savings by requiring washing of the outer pillow only and the inner pillow may not need to be washed as frequently as the outer pillow. This can reduce the weight in commercial laundering thus saving amount of energy and water consumed per wash cycle.

Hotels use hundreds of thousands of pillows to equip their hotel room beds with comfort and provide their customers a good night sleep. Each of these pillows weigh 2 lbs or more, and the cost of laundering these pillows can range anywhere from $0.50 per pound to $1.00 per pound per wash or more. Each of these pillows are washed at least once every quarter. Some hotels may wash the pillows more frequently. Therefore, the cost of laundering these pillows alone runs into several millions of dollars for each hotel, and the energy that's used to launder these pillows is also significant.

If these pillows are made per this invention, one can remove the pillow insert before washing and wash only the outer chamber. By using the embodiments of the present invention, hotels can save up to 90% or more of their costs for laundering as well as a corresponding amount of energy that is used to launder these pillows every time. Not to mention the savings in the resources such as personnel that may be carrying out these cleaning activities, as well as the resources, such as machinery, that may be used to carry out these cleaning activities.

Example embodiments disclosed herein result in significant cost savings for the hospitality industry, such as for example hoteliers, and significant energy savings for the laundromat, resulting in reduced greenhouse gas emissions.

The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also understood that additional or alternative steps may be employed.

The use of the expression "at least" or "at least one" suggests the use of one or more elements, as the use may be in one of the embodiments to achieve one or more of the desired objects or results.

The aim of this specification is to describe some example embodiments without limiting the disclosure to any one embodiment or specific collection of features. A person skilled in the relevant art may realize the variations from the specific embodiments that will nonetheless fall within the scope of the disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A pillow comprising:

an outer pillow having an inner cavity, the inner cavity being accessible through an opening on at least one side of the outer pillow and the opening configured with means to close the opening; and an insert or inner pillow configured to removably fit into the inner cavity of the outer pillow when inserted through the opening, wherein the opening is formed on a longer side of the outer pillow, wherein the outer pillow comprises a first outer layer, a first inner layer, a second inner layer, and a second outer layer, and a first stuffing material provided between the first outer layer and the first inner layer, and between the second inner layer and the second outer layer, wherein the first outer layer and the second outer layer comprise a down proof material, wherein the first inner layer and the second inner layer together provide the inner cavity of the outer pillow, and wherein the inner pillow comprises a third outer layer and a fourth outer layer, and a second stuffing material provided between the third outer layer and the fourth outer layer, wherein the third outer layer and the fourth outer layer of the inner pillow comprise a fluid impermeable material, wherein the outer pillow constitutes about 5-15% of the pillow by volume and the inner pillow constitutes about 85-95% of the pillow by volume.

2. The pillow of claim 1, wherein the outer pillow comprises a first stuffing material, the first stuffing material comprising natural or synthetic fillers.

3. The pillow of claim 2, wherein the first stuffing material for the outer pillow comprises down or down mixed or blended with feather.

4. The pillow of claim 2, wherein the first stuffing material for the outer pillow comprises polyester or foam or any other synthetic material.

5. The pillow of claim 1, wherein the insert or inner pillow comprises a second stuffing material, the second stuffing material comprising natural or synthetic fillers.

6. The pillow of claim 5, wherein the second stuffing material for the insert or inner pillow comprises blown fibers, cluster fibers, garneted fibers, shredded foam, down, feather, or combinations thereof.

7. The pillow of claim 5, wherein the second stuffing material for the insert or inner pillow comprises polyester or foam or a synthetic material.

8. The pillow of claim 1, wherein the means to close the opening comprises a zipper or a hook and loop type fastener or a snap button.

9. The pillow of claim 1, wherein the zipper is not conspicuous or easily seen or readily visible on the outside of the pillow.

10. The pillow of claim 1, wherein surfaces of the inner cavity and outer surface of the insert or inner pillow are lined with a smooth fabric that facilitates smooth insertion and removal of the insert or inner pillow from the inner cavity in the outer pillow.

11. The pillow of claim 1, wherein the third outer layer and the fourth outer layer of the insert or inner pillow comprise down proof material as defined by the International Down and Feather Testing Laboratory (IDFL).

12. The pillow of claim 1, wherein the opening is formed on the longer side and the shorter side of the outer pillow.

13. The pillow of claim 1, wherein the outer pillow comprises about 70-99% down clusters and about 1-30% feather by volume.

14. The pillow of claim 1, wherein the inner pillow comprises garneted polyester comprising about 0.25-0.50 inch polyester balls.

15. A pillow comprising:

an outer pillow having an inner cavity, the inner cavity being accessible through an opening on at least one side of the outer pillow; and an insert or inner pillow configured to removably fit into the inner cavity of the outer pillow when inserted through the opening, wherein the outer pillow comprises a first outer layer, a first inner layer, a second inner layer, and a second outer layer, and a first stuffing material provided between the first outer layer and the first inner layer, and between the second inner layer and the second outer layer, wherein the first outer layer and the second outer layer comprise a down proof material, wherein the first inner layer and the second inner layer together provide the inner cavity of the outer pillow, and wherein the inner pillow comprises a third outer layer and a fourth outer layer, and a second stuffing material provided between the third outer layer and the fourth outer layer, wherein the third outer layer and the fourth outer layer of the inner pillow comprise a fluid impermeable material, wherein the outer pillow constitutes about 5-15% of the pillow by volume and the inner pillow constitutes about 85-95% of the pillow by volume.

16. The pillow of claim 15, wherein the opening is configured with a zipper, a hook and loop type fastener, or a snap button to close the opening.

17. The pillow of claim 15, wherein the first stuffing material comprising natural or synthetic fillers.

18. The pillow of claim 17, wherein the first stuffing material for the outer pillow comprises down or down mixed or blended with feather.

19. The pillow of claim 15, wherein the second stuffing material comprising natural or synthetic fillers.

20. The pillow of claim 19, wherein the second stuffing material for the insert or inner pillow comprises blown fibers, cluster fibers, garneted fibers, shredded foam, down, feather, or combinations thereof.

21. The pillow of claim 15, wherein the opening is formed on the longer side and the shorter side of the outer pillow.

22. The pillow of claim 15, wherein the outer pillow comprises about 70-99% down clusters and about 1-30% feather by volume.

23. The pillow of claim 15, wherein the inner pillow comprises garneted polyester comprising about 0.25-0.50 inch polyester balls.

24. A method for manufacturing a pillow comprising:

providing an outer pillow having an inner cavity, the inner cavity being accessible through an opening on at least one side of the outer pillow; and providing an insert or inner pillow configured to removably fit into the inner cavity of the outer pillow when inserted through the opening, wherein the opening is formed on a longer side of the outer pillow, wherein the outer pillow comprises a first outer layer, a first inner layer, a second inner layer, and a second outer layer, and a first stuffing material provided between the first outer layer and the first inner layer, and between the second inner layer and the second outer layer, wherein the first outer layer and the second outer layer comprise a down proof material, wherein the first inner layer and the second inner layer together provide the inner cavity of the outer pillow, and wherein the inner pillow comprises a third outer layer and a fourth outer layer, and a second stuffing material provided between the third outer layer and the fourth outer layer, wherein the third outer layer and the fourth outer layer of the inner pillow comprise a fluid impermeable material, wherein the outer pillow constitutes about 5-15% of the pillow by volume and the inner pillow constitutes about 85-95% of the pillow by volume.

25. The method of claim 24, further comprising:

configuring the opening with a closing means to close the opening, the closing means comprising at least one of a zipper, a hook and loop type fastener, and a snap button.

* * * * *